US010943440B1

(12) United States Patent
Weiss

(10) Patent No.: US 10,943,440 B1
(45) Date of Patent: Mar. 9, 2021

(54) CASINO WAGERING GAME WITH PLAYER ADVANTAGE BY RECEIVING MORE CARDS THAN THE DEALER

(71) Applicant: Money$uit Industries LLC, Bellmore, NY (US)

(72) Inventor: Brent Weiss, Bellmore, NY (US)

(73) Assignee: Money$uit Industries LLC, Bellmore, NY (US)

( * ) Notice: Subject to any disclaimer, the term of this patent is extended or adjusted under 35 U.S.C. 154(b) by 0 days.

(21) Appl. No.: 16/543,601

(22) Filed: Aug. 18, 2019

Related U.S. Application Data

(63) Continuation-in-part of application No. 16/455,489, filed on Jun. 27, 2019, now abandoned.

(60) Provisional application No. 62/794,998, filed on Jan. 21, 2019.

(51) Int. Cl.
*G07F 17/32* (2006.01)
*A63F 1/00* (2006.01)

(52) U.S. Cl.
CPC ..... *G07F 17/3293* (2013.01); *A63F 1/00* (2013.01); *G07F 17/323* (2013.01); *G07F 17/3209* (2013.01); *G07F 17/3211* (2013.01); *G07F 17/3288* (2013.01); *A63F 2001/005* (2013.01); *G07F 17/3258* (2013.01)

(58) Field of Classification Search
USPC ..... 463/13
See application file for complete search history.

(56) References Cited

U.S. PATENT DOCUMENTS

| | | | | |
|---|---|---|---|---|
| 7,165,770 | B2 | 1/2007 | Snow | |
| 7,628,689 | B2 | 12/2009 | Snow | |
| 7,661,678 | B2 | 2/2010 | Snow | |
| 7,708,280 | B2 | 5/2010 | Friedman | |
| 2012/0280454 | A1 | 11/2012 | Snow | |
| 2014/0087806 | A1* | 3/2014 | Snow | A63F 1/00 463/13 |
| 2015/0379825 | A1* | 12/2015 | Snow | G07F 17/3223 463/13 |
| 2016/0089594 | A1* | 3/2016 | Yee | A63F 1/00 273/292 |
| 2016/0136511 | A9* | 5/2016 | Snow | G07F 17/3293 463/13 |
| 2016/0151700 | A1* | 6/2016 | Hemberger | A63F 1/00 273/292 |
| 2016/0171838 | A1* | 6/2016 | Snow | G07F 17/3262 463/13 |
| 2016/0220891 | A1* | 8/2016 | Hwang | G07F 17/3293 |
| 2018/0047255 | A1* | 2/2018 | Yee | G07F 17/3293 |
| 2018/0169507 | A1* | 6/2018 | Snow | A63F 1/00 |
| 2018/0169510 | A1* | 6/2018 | Snow | A63F 3/00157 |
| 2018/0276953 | A1* | 9/2018 | Snow | A63F 3/00157 |
| 2019/0035214 | A1* | 1/2019 | Yee | A63F 1/00 |
| 2019/0385416 | A1* | 12/2019 | Snow | G07F 17/3225 |

* cited by examiner

*Primary Examiner* — Pierre E Elisca
(74) *Attorney, Agent, or Firm* — Muskin and Farmer LLC

(57) ABSTRACT

A casino wagering game based on the card game of Poker. In this novel casino wagering game, the player has an advantage over the dealer as the player is dealt four cards to make their best three card hand, while the dealer is dealt only three cards. The goal is to get as high of a hand as possible and beat the hand of the dealer. The player benefits can include the ability to receive bonus payouts on high ranking hands that beat dealer's as well as bonuses for high ranking hands that tie or lose to the dealer.

20 Claims, 4 Drawing Sheets

CASINO WAGERING GAME WITH PLAYER ADVANTAGE BY RECEIVING MORE CARDS THAN THE DEALER

This application claims benefit to U.S. provisional 62/794,998, which is incorporated by reference herein in its entirety. Application Ser. No. 16/455,489 is also incorporated by reference herein in its entirety.

BACKGROUND OF THE INVENTION

1. Field of the Invention

The present inventive concept relates to a casino wagering game which can be played in table or electronic form.

2. Description of the Related Art

The card game of poker is a card game played between at least two players. Each player is dealt a hand of cards and the goal is to obtain the highest-ranking hand from a predetermined list as possible.

Casino wagering games are a big industry and casinos are always interested in new games that will provide exciting and profitable game play for the players. What is needed is a novel variant of the game of poker that can be offered by a casino to induce new clientele to participate in the casino's offerings.

SUMMARY OF THE INVENTION

It is an aspect of the present invention to provide an exciting wagering game.

The above aspects can be obtained by a method that includes (a) providing a physical deck of cards; (b) receiving an ante wager and required side wager from a player; (c) dealing a hand of cards to the player and the dealer, where the player receives more cards in its hand than that of the dealer; (d) determining a value of the hand, the value being determined by a predetermined list of hand hierarchy; and (e) paying the player a payout based upon the strength of said player's hand if the player's hand exceeds that of the Dealer's or if the player possesses a very strong hand and loses to the dealer's.

The above aspects can also be obtained by an electronic gaming device that includes (a) an output device; (b) a processing unit, executing instructions to perform the following operations: receiving an ante wager and required side wager from a player; (c) dealing and displaying on the output device a hand of cards to the players and the dealer, where the players receives more cards in its hand than that of the dealer; (d) determining a value of the hand, the value being determined by a predetermined list of hand hierarchy; (e) paying the player a payout based upon the strength of said player's hand if the player's hand exceeds that of the Dealer's or if the player possesses a very strong hand and loses to the dealer's.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
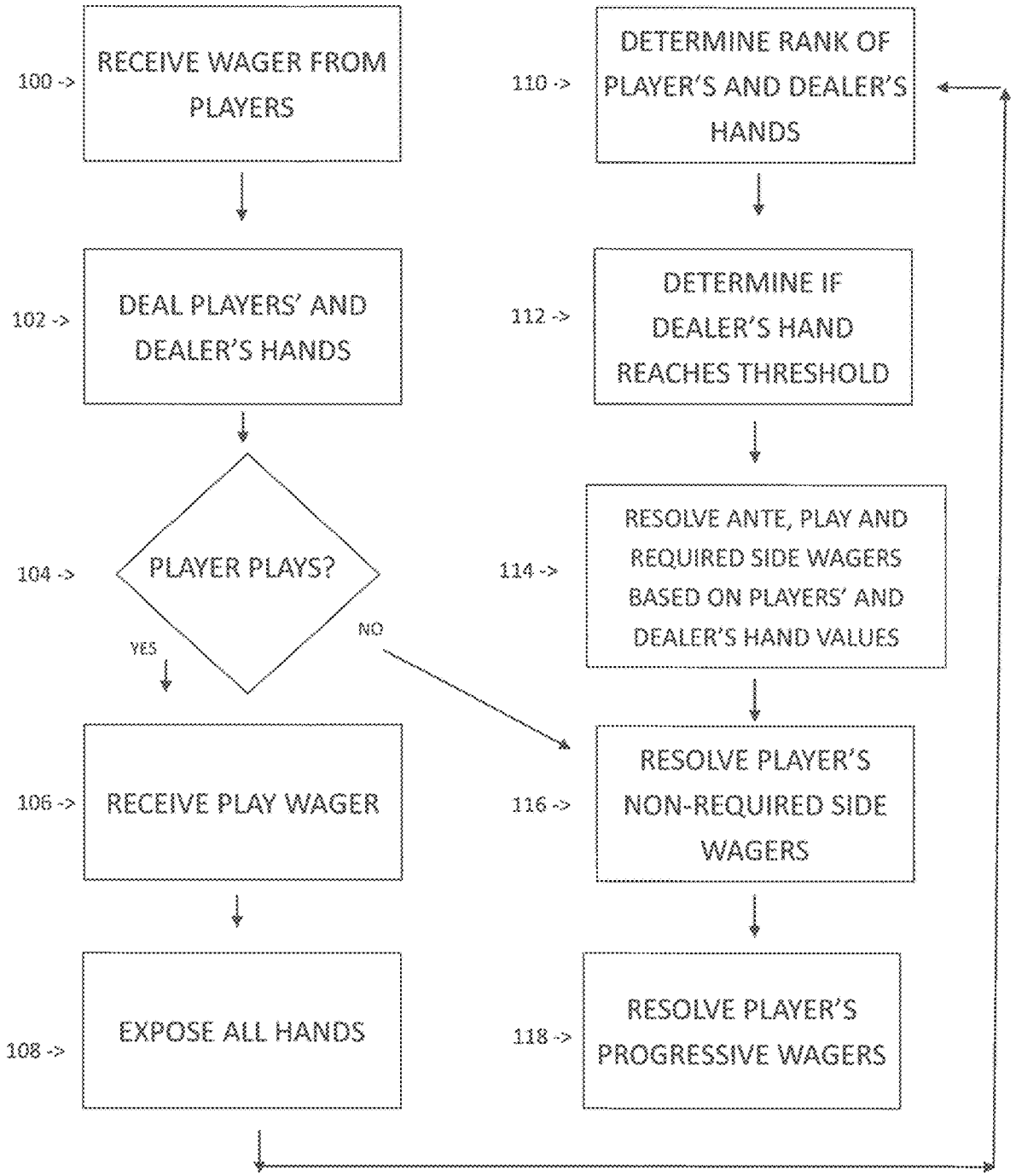
FIG. 1 is a flowchart illustrating an exemplary method of implementing a wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, system, and computer readable storage which allows a casino (or house) to offer a wagering game to players. The wagering game is generally played as follows. Each player places an ante wager and a required side wager. Each player is then dealt four cards from a standard 52 card deck of cards and the dealer shall be dealt only three cards from that same standard 52 card deck of cards. The player can review their cards and decide to play and place a play wager to enter the showdown against the dealer's hand to try and win or fold the hand and surrender both their ante and required side wagers.

The Player's and Dealer's hands will be ranked as the highest value against a predetermined hierarchy list of possible poker hands.

The goal of the player is to obtain the highest-ranking hand from a predetermined hierarchy list of possible poker hands which is higher than that of the Dealer's hand.

An additional non-required side wager can also be placed before the deal, wherein the players are simply looking to achieve the highest-ranking hand from a predetermined hierarchy list of possible poker hands comprised of all four of the player's cards dealt, regardless of the strength of the Dealer's hand.

A non-required progressive wager can also be made before the deal, and is paid based on a predetermined hierarchy list of possible poker hands comprised of all four of the player's cards dealt, regardless of the strength of the Dealer's hand.

FIG. 1 is a flowchart illustrating an exemplary method of implementing a wagering game, according to an embodiment.

The method can begin with operation 100, which receives wagers from each of the players. Multiple players can play the game simultaneously at the same table. Each player must place an ante wager and a required side wager. The ante wager and required side wager must be of equal value. These wagers can be made as known in the art, by placing chips (which can be directly redeemable for cash at a cashier) or cash on a betting circle on a felt layout used for the game. The player can optionally place a side wager by placing chips (which can be directly redeemable for cash at a cashier) or cash on a betting circle on a felt layout used for the game. The player can optionally place a progressive wager as well, which can be placed by inserting a dollar chip (or chip or coin of another denomination) into a slot, which registers that the player has made the progressive bet. The progressive wager/jackpot is of the kind described in U.S. Pat. No. 6,234,895, which is incorporated by reference herein in its entirety.

From operation 100, the method proceeds to operation 102, which deals all of the players' hands. Each player is dealt four cards and the dealer is dealt only three cards, all face down, although each player is permitted to look only at their own cards. Collaboration (looking at another player's cards) is typically not allowed.

From operation 102, the method proceeds to operation 104, wherein the player determines whether the player wishes to play or fold. If the player wishes to fold, then the player will forfeit his or her ante and required side wager (which will be collected by the dealer) and then the method proceeds to operation 116.

If in operation 104, the player decides to play, the method proceeds to operation 106, which receives the player's play wager. The play wager should typically be equal to the ante wager, although in another embodiment the play wager does not have to be equal to the ante wager.

Operations 102-106 will be repeated for each player at the table.

Once all the players have had a chance to play/fold, then the method proceeds to operation 108, which exposes all hands to all players. At this point the resolution of the game is deterministic, as the evaluation of all payouts is based on the revealed information.

From operation 108, the method proceeds to operation 110, which determines the rank of each player's best three card hand and that of the dealers. This is determined as described herein.

From operation 110, the method proceeds to operation 112, which it is determined if the dealer's hand reaches a predetermined threshold.

From operation 112, the method proceeds to operation 114, which resolves each player's ante, play and required side wager based on the player's hand rank versus that of the dealer's hand rank and if the dealer's hand reached the predetermined threshold (as determined in operation 112). If the player's best three out of four card hand is a higher rank than the dealer's, and the dealer's hand has achieved the predetermined threshold (as determined in operation 112), the ante and play wagers both pay even money. If the player's best three out of four card hand is a higher rank than the dealer's, and the dealer's hand has not achieved the predetermined threshold (as determined in operation 112), the ante wager will pay even money and the play wager will be deemed inactive and returned to the player as if not placed. The player's required side wager shall be resolved according to the following pay table example (Table I).

TABLE I

| Event | Player's Hand Beats the Dealer's | Player's Hand Ties the Dealer's | Player's Hand Loses to the Dealer's |
|---|---|---|---|
| Other | Lose | Lose | Lose |
| Flush | Push | Push | Lose |

TABLE I-continued

| Event | Player's Hand Beats the Dealer's | Player's Hand Ties the Dealer's | Player's Hand Loses to the Dealer's |
|---|---|---|---|
| Straight | 1 to 1 | Push | Lose |
| Three of a kind | 5 to 1 | N/A | 250 to 1 |
| Straight Flush | 10 to 1 | 250 to 1 | 250 to 1 |
| Mini-Royal (AKQ) | 25 to 1 | 250 to 1 | 250 to 1 |

As known in the art, losing wagers are taken from the player by the dealer and the dealer also pays out winning wagers (typically in chips) to the player. However, the Player's required side wager will be paid in certain events as described in the example "Table I" expressed above. Additionally, when a Player's hand loses to the dealer and the dealer's hand has not achieved the predetermined threshold (as determined in operation 112), the ante wager will be taken by the dealer and the play wager will be deemed inactive and returned to the player as if not placed.

Operations 108-114 are repeated for each live player at the table (each player that did not fold in operation 104).

From operation 114, the method proceeds to operation 116, which resolves each player's non-required side wager based on the player's hand rank irrespective of the strength of the dealer's hand. The player's non-required side wager shall be resolved according to the following pay table example (Table II).

TABLE II

| Event | Pays |
|---|---|
| Other | −1 |
| 3 Card Straight or Flush | 1 to 1 |
| 4 Card Straight or Flush | 7 to 1 |
| 3 Card Straight Flush or Three of a kind | 11 to 1 |
| 4 Card Straight Flush | 250 to 1 |
| Four of a kind | 500 to 1 |
| 4 Card Royal Family | 1000 to 1 |

From operation 116, the method proceeds to operation 118, which resolves each player's progressive (also known as jackpot) wagers. The progressive jackpot is fed by the progressive jackpot wagers, although the house would typically take out a fixed percentage of each jackpot wager before feeding the rest into the progressive jackpot [e.g., if the progressive jackpot bet is a fixed $1 bet (other denomination can be used), and for each $1 bet, the house keeps 10 cents, or any other amount]. Any winning progressive wager is paid while any losing progressive wager is collected (or would have been collected immediately after operation 100).

Table III below illustrates one sample pay table for the progressive jackpot. Of course, other payouts can be used as well.

TABLE III

| event | pays |
|---|---|
| 4 Card Straight Flush | $250 (fixed amount) |
| Four of a Kind | %20 of progressive |
| Royal Family (AKQJ) | %100 of progressive |
| all others | 0 |

Operations 114-118 are repeated for each player at the table.

At this point, the game is over. All wagers should have been resolved (collected or paid). The cards can be collected and reshuffled in a shuffling machine (or by hand), and a new game can begin back at operation 100.

It is noted that the order of operations in FIG. 1 can occur using any operable orders as well. Any other variants of the order of operations are included within the scope of FIG. 1.

Figure 2A:
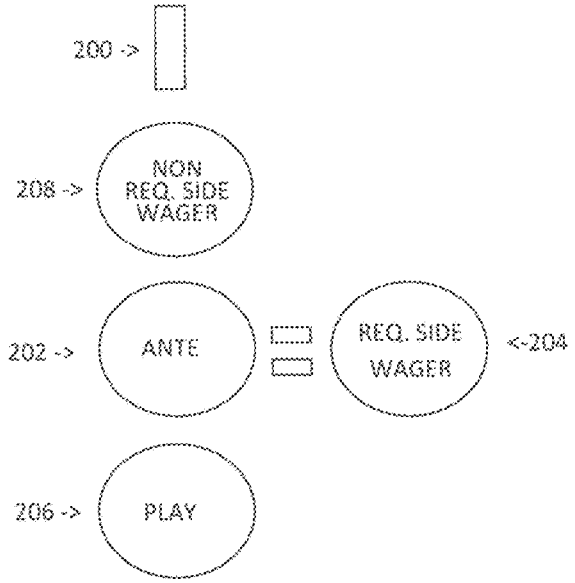
FIG. 2A is an exemplary playing layout for a single player, according to an embodiment.

FIG. 2A is an exemplary playing layout for a single player, according to an embodiment. It is noted that this is just one sample layout, and numerous other configurations can be used as well.

A progressive wager slot 200 is used to receive the player's progressive wager at the beginning of the game (operation 100). Once the wager is made (typically a dollar chip or coin, although other denomination can be used), the coin can be mechanically dropped through a slot and collected in a collection box, while the player is given credit for making the progressive wager and thus making the player eligible to win the progressive jackpot. If the player does not make the progressive wager then the player is not eligible to win the progressive jackpot.

An "ante" wager betting circle 202, "Req. Side Wager" betting circle 204 and "Non Req. Side Wager" betting circle 208 is where the player places his or her ante wager, required side wager and non-required side wagers at the beginning of the game (operation 100). A play wager betting circle 206 is where the player places his or her play wager (operation 106).

Figure 2B:
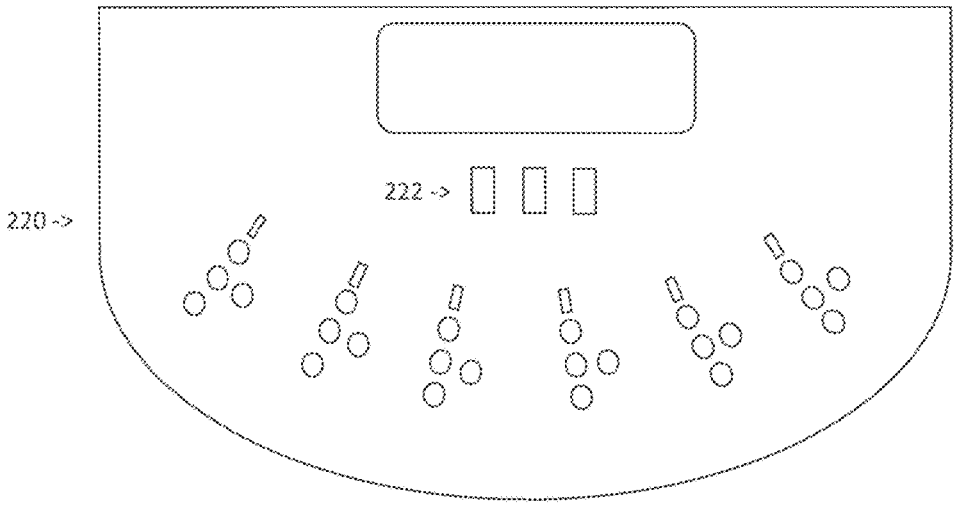
FIG. 2B is an exemplary table layout, according to an embodiment.

FIG. 2B is an exemplary table layout, according to an embodiment.

While the layout illustrated in FIG. 2B can accommodate up to six players, of course such a table can be designed to accommodate any number of players (e.g., 2-10). The table 220 is a standard gaming table as known in the art, with a felt layout on top which has the layouts embedded therein on the felt. Dealer card boxes 222 are where the dealer will place his or her cards once all hands are dealt (operation 102).

While the game described herein can played physical (using physical cards, physical chips/cash, physical table, etc.), the game can also be played electronically implemented by a computer.

Figure 3A:
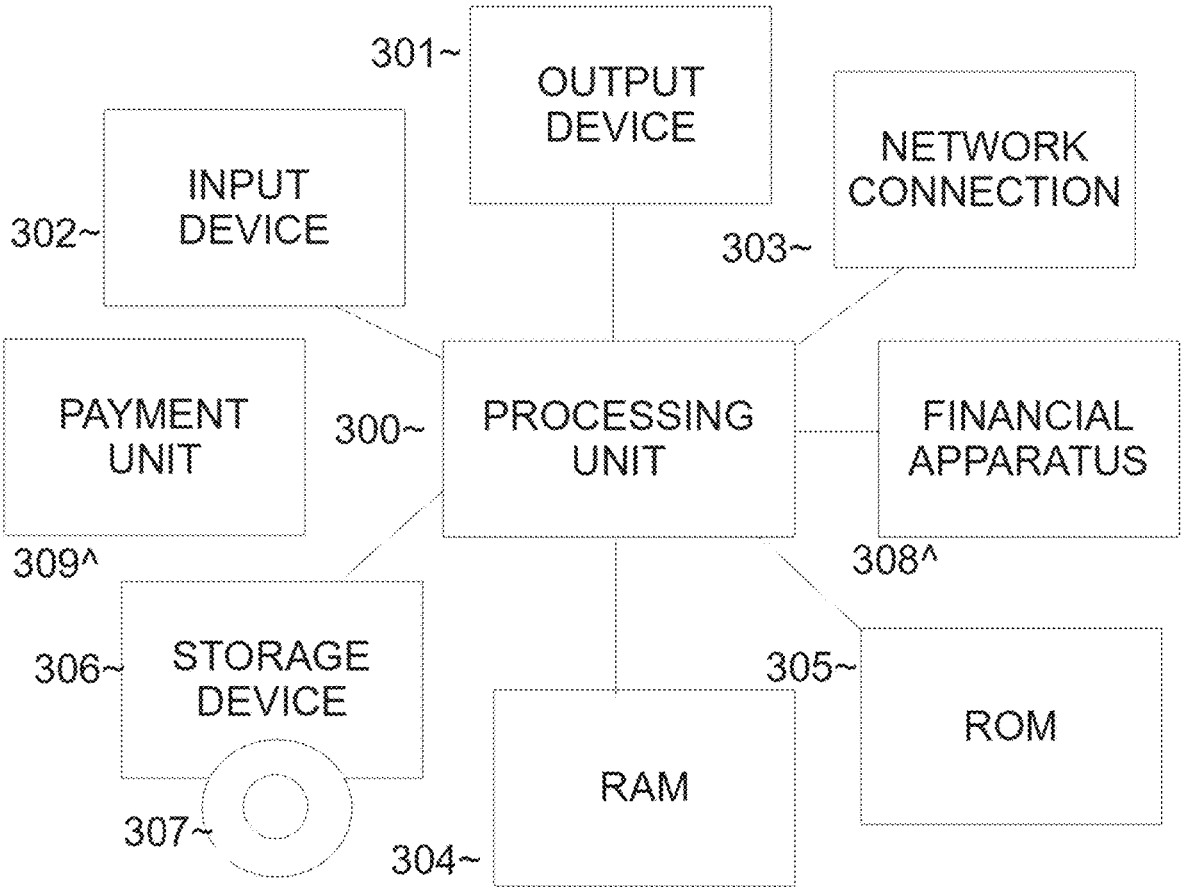
FIG. 3A is a block diagram illustrating hardware that can be used to implement electronic versions of the wagering methods described herein, according to an embodiment.

FIG. 3A is a block diagram illustrating hardware that can be used to implement electronic versions of the wagering methods described herein, according to an embodiment. The hardware can be, for example, an electronic gaming machine (EGM) used in casinos. The hardware can also be a personal computer, playing the game using the Internet at an Internet casino for real money. The hardware can also be a digital casino table, for example the kind described in U.S. Pat. No. 7,775,887, which is incorporated by reference herein in its entirety. The hardware can also be any computing device, such as a cellular phone, tablet, etc., and the methods described herein can be installed as software (e.g., an app) on the device. The hardware can also be any other type of device, working individually or in conjunction with other devices. The hardware can also be a digital poker table, of the kind described in U.S. Pat. No. 7,758,411 which is incorporated by reference herein in its entirety. The game described herein can also be played on an electronic gaming device of the kind described in U.S. Pat. No. 9,905,079 which is incorporated by reference herein in its entirety.

A processing unit 300 (such as a microprocessor and any associated components) is connected to an output device 301 (such as an LCD monitor, touch screen, CRT, etc.) which is used to display to the player any aspect/step of the method (e.g., all of the cards dealt, wagers made, etc.), and an input device 302 (e.g., buttons, a touch screen, a keyboard, mouse, etc.) which can be used to input from the player any decision made by the player (e.g., how much to wager, playing decisions(s), etc.) All methods described herein can be performed by the processing unit 300 by loading and executing respective instructions which are programmed to implement any of the methods/features described herein. The processing unit 300 can also be connected to a network connection 303, which can connect the electronic gaming device to a computer communications network such as the Internet, a LAN, WAN, etc. The processing unit 300 is also connected to a RAM 304 and a ROM 305. The processing unit 300 is also connected to a storage device 306 which can be a DVD-drive, CD-ROM, flash memory, etc. Multiple such processing units can also work in collaboration with each other (in a same or different physical location). A non-transitory computer readable storage medium 307 can store a program which can control the electronic device to perform any of the methods described herein and can be read by the storage device 306. The processing unit 300 can also be connected to a financial apparatus 308 (e.g., a bill acceptor) which can receive cash and convert the received cash into playable credits for use by the player when playing the electronic device (the credits represent cash and are used to make the wagers). When the player decides to cash out any remaining credits, the financial apparatus 308 (or a separate payment unit 309) can also dispense coins and/or issue/print a cashless ticket (cashless voucher) for the remaining credits which are redeemable by the player (i.e., the cashless ticket can be exchanged at a kiosk for an equivalent amount of cash).

While one processing unit is shown, it can be appreciated that one or more such processor can work together (either in a same physical location or in different locations) to combine to implement any of the methods described herein. Programs and/or data required to implement any of the methods/features described herein can all be stored on any non-transitory computer readable storage medium (volatile or non-volatile, such as CD-ROM, RAM, ROM, EPROM, microprocessor cache, etc.)

Figure 3B:
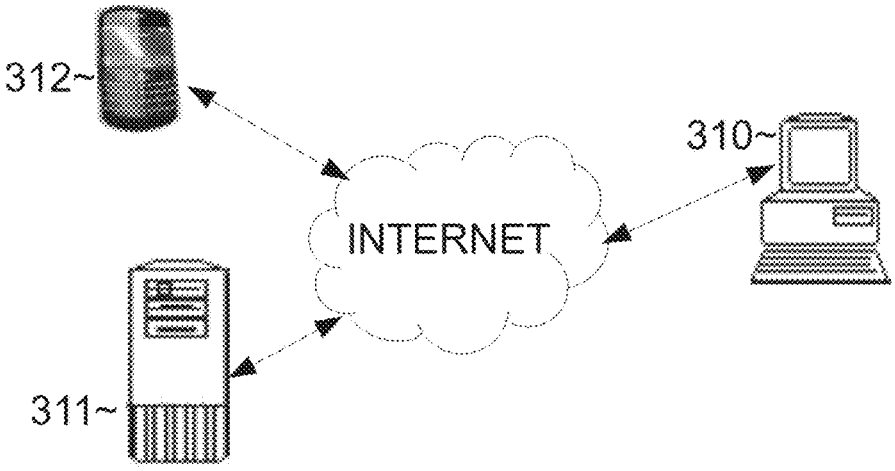
FIG. 3B is a block diagram illustrating an exemplary network configuration to implement a player playing an online version of the methods described herein.

FIG. 3B is a block diagram illustrating an exemplary network configuration to implement a player playing an online version of the methods described herein. All the methods described herein can be implemented on an online casino for real money (credits which are purchased for cash and are redeemable for cash) or for non-cash value credits. A player uses a personal computer 310 (e.g., cell phone, tablet, PC, etc.) can connect to a server 311 (which can have the structure illustrated in FIG. 3A) using a computer communications network such as the Internet. The server 311 hosts an online casino which determines the outcomes of the game and serves the outcomes to the computer 310 so the computer 310 displays the outcomes to the player. Other users can also play at the online casino hosted by the server 311 simultaneously, such as using a cell phone 312 with wireless internet connectivity. Any number of players (e.g., 1 to 100 or more than 100) can be connected to the internet and can play simultaneously on the sever 311 even though these players are all located in different physical locations. The general structure of online casinos is well known in the art.

Note that in the embodiments played using computers (a processor/processing unit), "virtual deck(s)" of cards are used instead of physical decks. A virtual deck is an electronic data structure used to represent a physical deck of cards which uses electronic representations for each respective card in the deck. A virtual card is displayed on an electronic output device using computer graphics and is displayed to mimic a real life image of that card. The virtual deck can be "shuffled" (by rearranged the computer representations of the cards) so that random cards are dealt (displayed on the output device) during the game. Random cards can be selected using a random number generator (RNG) as known in the art. The virtual deck can also be shuffled using the RNG.

Methods described herein can also be played on a physical table using physical cards and physical chips used to place wagers. Such physical chips can be directly redeemable for cash. When a player wins (dealer loses) the player's wager, the dealer will pay that player a respective payout amount. When a player loses (dealer wins) the player's wager, the dealer will take (collect) that wager from the player and typically place those chips in the dealer's chip rack. All rules, embodiments, features, etc. of a game being played are typically communicated to the player (e.g., verbally or on a written rule card) before the game begins.

Initial cash deposits can be made into the electronic gaming machine which converts cash into electronic credits. All wagers can be placed in the form of electronic credits (and wins are paid in credits), which can be cashed out for real coins or a ticket (e.g., ticket-in-ticket-out) which can be redeemed at a casino cashier or kiosk for real cash and/or coins.

Figure 4:
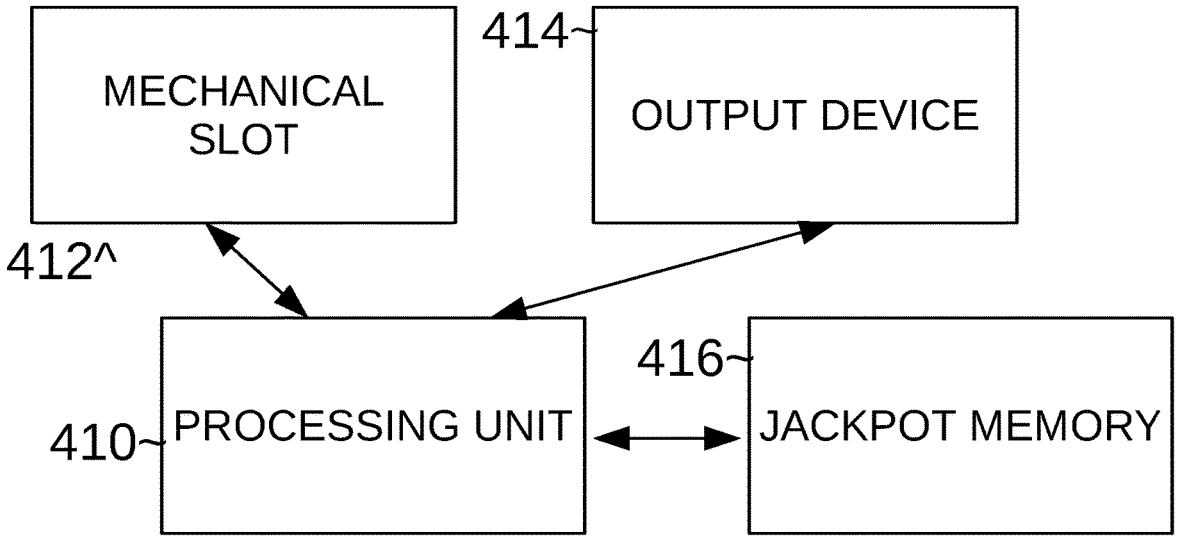
FIG. 4 is an exemplary block diagram of a progressive jackpot processor, according to an embodiment.

FIG. 4 is an exemplary block diagram of a progressive jackpot processor, according to an embodiment.

A processing unit 410 can be a microprocessor (and any associated structure, such as bus, cache, etc.) The processing unit 410 can be connected to a mechanical slot 412 such as progressive wager slot 200. The mechanical slot 412 can be opened by the processing unit 410 which can send the coin (or chip) inserted inside the mechanical slot 412 to a collecting container (not picture) using the force of gravity. The processing unit 410 is also connected to an output device 414 which displays the current amount of the progressive jackpot. The processing unit 410 will also adjust the amount of the progressive jackpot accordingly based on new wagers received. The processing unit 410 is also connected to a jackpot memory 416 which stores the current amount of the progressive jackpot.

Figure 5:
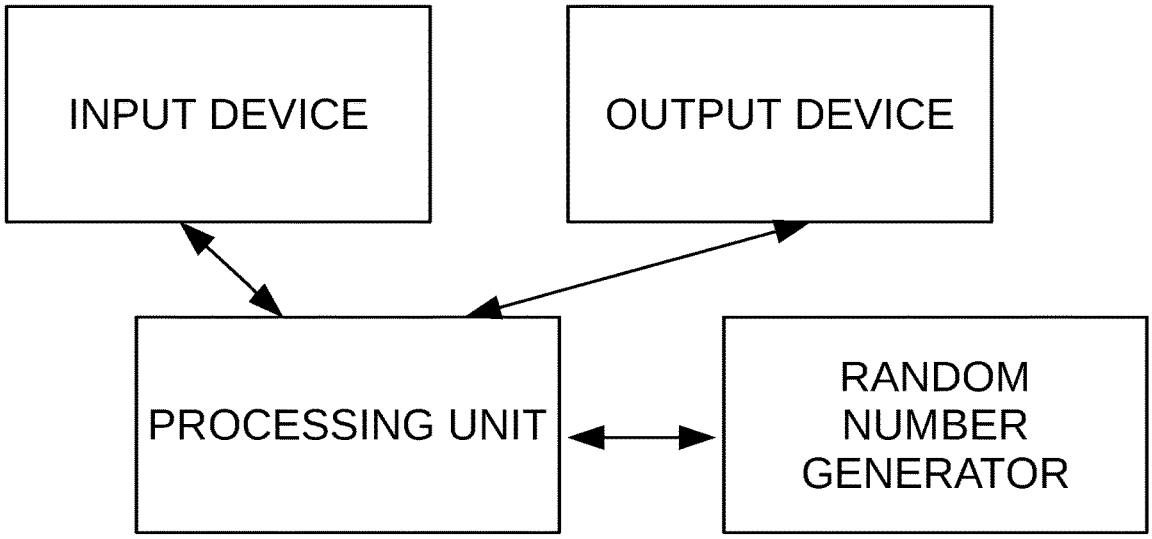
FIG. 5 is a simplification of the progressive jackpot wagering system.

FIG. 5 is a simplification of the progressive jackpot wagering system described in U.S. Pat. No. 6,234,895, which is incorporated by reference herein in its entirety. Such a system can be optionally used with the methods described herein in order to provide a progressive jackpot when the player is dealt predetermined hand(s).

An example of the game will now be presented to illustrate the game, using the payouts illustrated in Tables I, II and III. Of course, this is merely one example and it can be appreciated that a very large number of actual game instances can occur.

Joe sits down at a table and places bet of $1 on the ante wager, $1 on the required side wager, $1 on the non-required side wager and $1 on the progressive wager. When all bets are placed, the progressive wager is collected by the house. Joe is dealt: 10 clubs, 9 clubs, 8 hearts and the 7 of diamonds.

Joe has a 3 Card Straight for the base game (Ante, Play and Required Side Wagers) and decides to play the hand in hopes of beating the dealer and places a $1 Play wager.

The hand is now over and the dealer exposes all hands at the table. The dealer's hand is composed of the 10 of hearts, 10 of diamonds and the 2 of spades. In this embodiment the dealer's threshold hand which activates the play wager is a king high or better, which here has been achieved with a pair of tens.

Joe's Ante and Play wagers will pay even money because his hand is a higher rank than the dealer's hand.

Joe's required side wager will also pay even money, based on "Table I" above, due to his hand value of a straight which beat the dealer's hand.

Joe's non-required side wager will pay 7 to 1, based on "Table II" above, due to his hand value of a 4 Card Straight.

Joe was not dealt a jackpot hand (e.g. a 4 Card Straight Flush, Four of a Kind or a Royal Family), that would qualify him for the progressive jackpot, so Joe is not paid the progressive jackpot. The game is now over, the dealer collects all cards, and a new game can begin.

Any embodiments described herein can be played with a standard deck of cards or any type of special deck (e.g. a Spanish deck, etc.) The game can also be played with a single deck or multiple decks (e.g. 1-8 decks or more). Further, the order of any of the operations described herein can be performed in any order and wagers can be placed/resolved in any order. Any methods described herein can also be played in electronic form and programs and/or data for such can be stored on any type of computer readable storage medium (e.g. CD-ROM, DVD, disk, etc.)

Hands and cards are dealt to players randomly, and upon each new game the deck(s) would be typically shuffled.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method, comprising:

providing an electronic input device;

providing an electronic output device;

providing an electronic processor connected to the input device and the output device, the processor executing non-transitory computer readable instructions which perform:

receiving an ante wager and a required side wager from a player;

dealing a dealer's hand of X cards face down;

dealing a player's hand of Y cards, wherein the player is enabled to view the player's hand, wherein Y is greater than X;

receiving a decision from a player, the decision being in a set comprising fold and play, wherein the decision is play and a play wager is received from the player;

providing gameplay rules comprising:

if a hand rank of the dealer's hand is at least a first predetermined rank, then if a) a hand rank of the player's hand beats the hand rank of the dealer's hand then paying both the ante wager and the play wager, and if b) the hand rank of the player's hand is lower than the hand rank of the dealer's hand, then both the ante wager and the play wager lose;

if the hand rank of the dealer's hand has a rank lower than the first predetermined rank, then if a) the hand rank of the player's hand beats the hand rank of the dealer's hand then paying the ante wager and pushing the play wager, and if b) the hand rank of the player's hand is lower than the hand rank of the dealers hand, then the ante wager loses and the play wager pushes; and implementing the gameplay rules.

2. The method as recited in claim 1, wherein Y is one greater than X.

3. The method as recited in claim 1, wherein Y=4 and X=3.

4. The method as recited in claim 1, wherein the first predetermined rank is King high.

5. The method as recited in claim 1, wherein a winning ante wager is paid even money.

6. The method as recited in claim 1, wherein a winning play wager is paid even money.

7. The method as recited in claim 1, the hand rank of the player's hand is determined using a best Z cards out of the Y cards in the player's hand, wherein Z is less than Y.

8. The method as recited in claim 7, wherein Y=4 and Z=3.

9. The method as recited in claim 1, further comprising, resolving the required side wager using the hand rank of the player's hand compared to the hand rank of the dealer's hand.

10. The method as recited in claim 1, further comprising, receiving an optional side wager along with the ante wager and the required side wager, and resolving the optional side wager based on a hand rank of the player's hand using all of the Y cards in the player's hand regardless of the hand rank of the dealer's hand.

11. An apparatus, comprising:

an electronic input device;

an electronic output device;

an electronic processor configured to read and execute non-transitory computer readable instructions from a computer readable storage medium, the computer readable instructions programmed to perform:

receive an ante wager and a required side wager from a player;

deal a dealer's hand of X cards face down;

deal a player's hand of Y cards, wherein the player is enabled to view the player's hand, wherein Y is greater than X;

receive a decision from a player, the decision being in a set comprising fold and play, wherein if the decision is play then a play wager is received from the player, and if the decision is fold then the player loses both the ante wager and required side wager;

if the decision is play and a hand rank of the dealer's hand is at least a first predetermined rank, then if a) a hand rank of the player's hand beats the hand rank of the dealer's hand then pay both the ante wager and the play wager, and if b) the hand rank of the player's hand is lower than the hand rank of the dealer's hand, then both the ante wager and the play wager lose;

if the decision is play and the hand rank of the dealer's hand has a rank lower than the first predetermined rank, then if a) the hand rank of the player's hand beats the hand rank of the dealer's hand then pay the ante wager and pushing the play wager, and if b) the hand rank of the player's hand is lower than the hand rank of the dealers hand, then the ante wager loses and the player wager pushes.

12. The apparatus as recited in claim 11, wherein the computer readable instructions are further programmed such that Y is one greater than X.

13. The apparatus as recited in claim 11, wherein the computer readable instructions are further programmed such that Y=4 and X=3.

14. The apparatus as recited in claim 11, wherein the computer readable instructions are further programmed such that the first predetermined rank is king high.

15. The apparatus as recited in claim 11, wherein the computer readable instructions are further programmed such that a winning play wager is paid even money.

16. The apparatus as recited in claim 11, wherein the computer readable instructions are further programmed such that the hand rank of the player's hand is determined using a best Z cards out of the Y cards in the player's hand, wherein Z is less than Y.

17. The apparatus as recited in claim 11, wherein the computer readable instructions are further programmed wherein Y=4 and Z=3.

18. The apparatus as recited in claim 11, wherein the computer readable instructions are further programmed to resolve the required side wager using the hand rank of the player's hand compared to the hand rank of the dealer's hand.

19. The apparatus as recited in claim 11, wherein the computer readable instructions are further programmed to receive an optional side wager along with the ante wager and the required side wager, and resolve the optional side wager based on a hand rank of the player's hand using all of the Y cards in the player's hand regardless of the hand rank of the dealer's hand.

20. A method, comprising:

providing a physical deck of cards;

receiving an ante wager and a required side wager from a player;

dealing from the deck a dealer's hand of X cards face down;

dealing from the deck a player's hand of Y cards, wherein the player is enabled to view the player's hand, wherein Y is greater than X;

receiving a decision from a player, the decision being in a set comprising fold and play, wherein the decision is play and a play wager is received from the player;

providing gameplay rules comprising:

if a hand rank of the dealer's hand is at least a first predetermined rank, then if a) a hand rank of the player's hand beats the hand rank of the dealer's hand then paying both the ante wager and the play wager, and if b) the hand rank of the player's hand is lower than the hand rank of the dealer's hand, then both the ante wager and the play wager lose;

if the hand rank of the dealer's hand has a rank lower than the first predetermined rank, then if a) the hand rank of the player's hand beats the hand rank of the dealer's hand then paying the ante wager and pushing the play wager, and if b) the hand rank of the player's hand is lower than the hand rank of the dealers hand, then the ante wager loses and the player wager pushes; and implementing the gameplay rules.

* * * * *